US007555507B2

(12) United States Patent
Bryant et al.

(10) Patent No.: US 7,555,507 B2
(45) Date of Patent: Jun. 30, 2009

(54) APPARATUS FOR SOLVING DIFFERENTIAL EQUATIONS

(75) Inventors: Michael Bryant, Austin, TX (US); Ashish Seth, Mumbai (IN); Benito Fernandez, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 780 days.

(21) Appl. No.: 11/303,172

(22) Filed: Dec. 16, 2005

(65) Prior Publication Data

US 2006/0117083 A1 Jun. 1, 2006

(51) Int. Cl.
*G06J 1/00* (2006.01)
*G06G 7/18* (2006.01)

(52) U.S. Cl. ..... 708/6; 708/822

(58) Field of Classification Search ..... 708/6, 708/443, 822
See application file for complete search history.

(56) References Cited

U.S. PATENT DOCUMENTS 3,119,928 A * 1/1964 Skramstad ..... 708/6
3,152,249 A * 10/1964 Hermann ..... 708/6

* cited by examiner

*Primary Examiner*—Tan V Mai
(74) *Attorney, Agent, or Firm*—Antony P. Ng; Dillon & Yudell LLP

(57) ABSTRACT

An apparatus for solving time-continuous differential equations is disclosed. The apparatus includes a group of hybrid integrators interconnected to each other. Each one of the hybrid integrators includes an analog integrator, a conversion logic and multiple digital registers. The analog integrator generates an analog output, and the conversion logic along with the digital registers converts the analog output to a digital output. The analog output and the digital output are then combined to yield an integrated output. The integrated output is fed to the hybrid integrators within the group.

10 Claims, 3 Drawing Sheets

APPARATUS FOR SOLVING DIFFERENTIAL EQUATIONS

CROSS REFERENCE TO RELATED APPLICATIONS

The present application claims benefit of priority under 35 U.S.C. §§ 120, 365 to the previously filed international patent application Ser. No. PCT/US2004/019476 entitled, "Hybrid Computation Apparatus, Systems, and Methods," filed on Jun. 17, 2004 having a priority date of Jun. 17, 2003 based upon U.S. Patent Application Ser. No. 60/479,197, both of which are incorporated by reference herein.

BACKGROUND OF THE INVENTION

1. Technical Field

The present invention relates to data processing in general, and in particular to an apparatus for solving differential equations. Still more particularly, the present invention relates to an apparatus for solving very-large scale systems of time-continuous differential equations.

2. Description of Related Art

Generally, analog computers can be set up to solve very-large scale systems of time-continuous differential equations. However, difficulties may arise due to a number of factors. For example, magnitude scaling problems arise when analog components exceed the limits imposed by supply voltages, and time scaling problems may occur from time constants associated with analog integrators. In addition, accuracy problems can be caused by factors such as components not being of desired values, circuit analysis approximations, and intrinsic electronic noise generated by resistors (thermal noise), direct currents (shot noise), active devices (flicker and popcorn noise), etc. Hence, although analog computers can be a powerful tool for solving very-large scale systems of differential equations, their power is severely restrained by the above-mentioned problems.

On the other hand, time-continuous differential equations may be simulated and numerically solved by using digital computers with an appropriate numerical method. With derivatives approximated by finite differences, a system of time-continuous differential equations can be converted into an equivalent system of time-discrete difference equations. However, solving a dynamic system using difference equations may lead to numerical instability and accuracy problems, which include stiff system issues, function smoothness difficulties, rounding and truncation errors, and error buildup. Thus, the usage of digital computers to solve time-continuous differential equations also suffer from various limitations.

Consequently, it would be desirable to provide an improved apparatus for solving very-large scale systems of time-continuous differential equations.

SUMMARY OF THE INVENTION

In accordance with a preferred embodiment of the present invention, an apparatus for solving systems of time-continuous differential equations includes a group of hybrid integrators interconnected to each other. Each one of the hybrid integrators includes an analog integrator, a conversion logic and multiple digital registers. The analog integrator generates an analog output, and the conversion logic along with the digital registers converts the analog output to a digital output. The analog output and the digital output are then combined to yield an integrated output. The integrated output is fed to the hybrid integrators within the group.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

In general, a differential equation has a derivative x'=dx/dt, and the derivative can be expressed as:

$$X^{\prime}=f(X,t) \tag{1}$$

Equation (1) is written in vector form. With f(X,t) being linear, equation (1) can be represented by a system of linear equations as follows:

$$x_k^{\prime} = \sum_{j=1}^{n} a_{jk} x_j + g_k(t) \tag{2}$$

for k=1, 2, . . . , n. The right-hand side of equation (2) can be integrated into states $x_k(t)$ by using an analog computer having multiple integrators. Algebraic operations such as additions, multiplications, and divisions inherent in f(X,t) can be implemented with active analog circuits such as operational amplifiers, augmented with digital circuits such as embedded logic.

Figure 1:
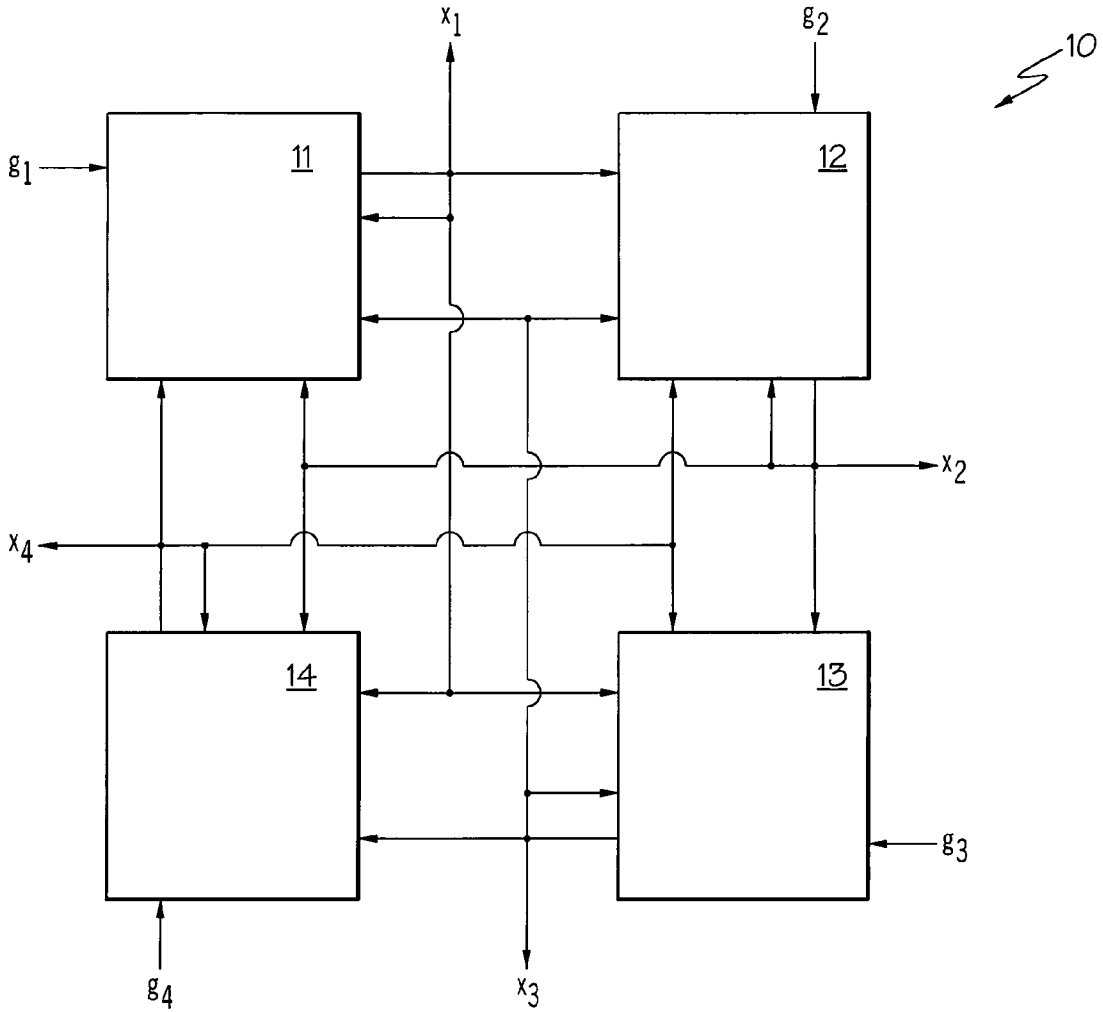
FIG. 1 is a block diagram of an apparatus for solving differential equations, in accordance with a preferred embodiment of the present invention.

Referring now to the drawings and in particular to FIG. 1, there is depicted a block diagram of an apparatus for solving differential equations by implementing the right-hand side of equation (2), in accordance with a preferred embodiment of the present invention. As shown, an apparatus 10 includes four hybrid integrators 11-14 interconnected to each other to implement the right-hand side of equation (2) where n is four. Basically, the value of n dictates the minimum number of hybrid integrators required to implement the right-hand side of equation (2). The output $x_k$ of each of hybrid integrators 11-14 is sent to the inputs of hybrid integrators 11-14. For example, an output $x_1$ of hybrid integrator 11 is sent to the inputs of hybrid integrators 11-14, an output $x_2$ of hybrid integrator 11 is sent to the inputs of hybrid integrators 11-14, etc. In addition, each of hybrid integrators 11-14 receives an additional input $g_k$. For example, hybrid integrator 11 receives $g_1$ as an additional input, hybrid integrator 12 receives $g_2$ as an additional input, etc.

Figure 2:
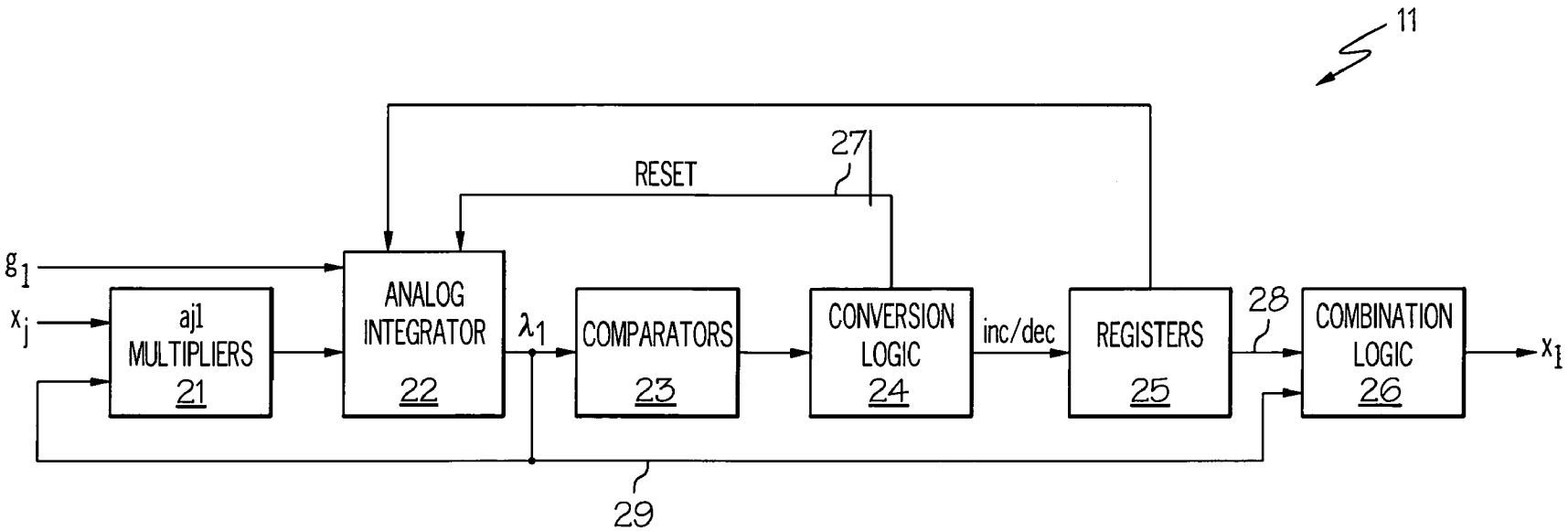
FIG. 2 is a block diagram of a hybrid integrator within the apparatus from FIG. 1, in accordance with a preferred embodiment of the present invention.

Since hybrid integrators 11-14 are substantially identical to each other, only hybrid integrator 11 will be further described. With reference now to FIG. 2, there is illustrated a block diagram of hybrid integrator 11, in accordance with a preferred embodiment of the present invention. As shown, hybrid integrator 11 includes $a_{j1}$ multipliers 21 and an analog integrator 22 to provide an analog output of $x_1-\lambda_1$. The analog output of $x_1$ ($\lambda_1$) is fed back into one of $a_{j1}$ multipliers 21 via a line 29, and analog outputs $x_j$ (where $j\neq1$) from hybrid integrators 12-14 (from FIG. 1) are fed into hybrid integrator 11 via the rest of $a_{j1}$ multipliers 21. A single line, $x_1$, is shown in FIG. 2, even though there are three similar lines for $x_2$, $x_3$ and $x_4$ signals respectively. The analog output of $x_1$ ($\lambda_1$) is also sent to comparators 23. Conversion logic 24 and registers 25 convert the output of comparators 23 to a digital output of $x_1$ via a line 28. A combination circuit 26 combines the analog output of $x_1$ ($\lambda_1$) from line 29 and the digital output of $x_1$ from line 28 to yield an integrated output $x_1$ that can be fed into hybrid integrator 11 and hybrid integrators 12-14 as input $x_1$. Input $g_1$ is fed into hybrid integrator 11 via analog integrator 22. Each time analog integrator 22 reaches one or more thresholds, conversion logic 24 can reset analog integrator 22 back to zero via a reset line 27.

Figure 3:
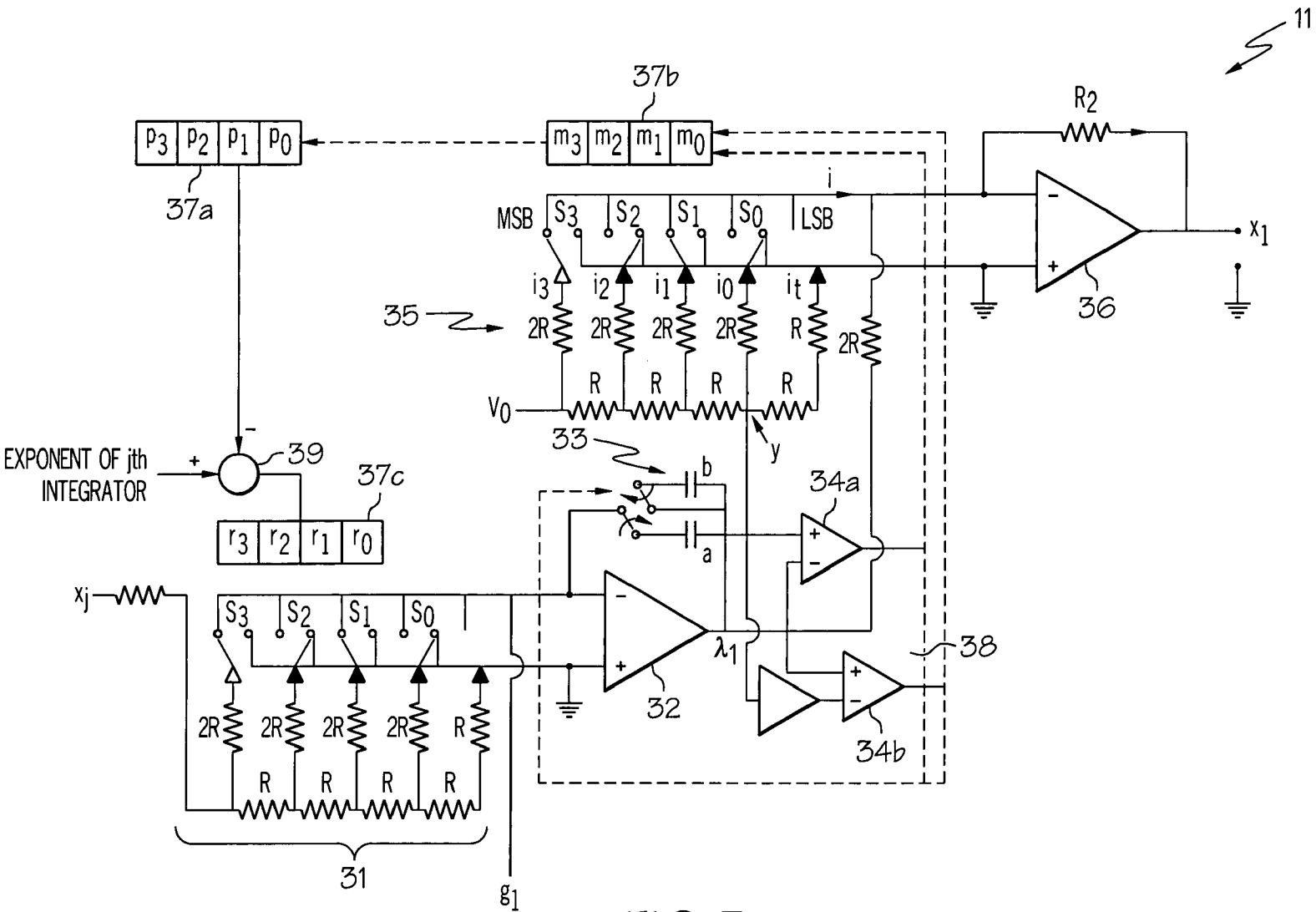
FIG. 3 is a circuit diagram of the hybrid integrator from FIG. 2, in accordance with a preferred embodiment of the present invention.

Referring now to FIG. 3, there is depicted a circuit diagram of hybrid integrator 11, in accordance with a preferred embodiment of the present invention. As shown, one of $a_{j1}$ multipliers 21 includes a resistor ladder 31 for receiving input $x_j$. Analog integrator 22, which includes an operational amplifier 32 along with multiple integration capacitors 33, integrates the outputs from resistor ladder 31 and input $g_1$. Comparators 23 includes operational amplifiers 34*a*-34*b*. Registers 25 includes an exponent register 37*a*, a mantissa register 37*b* and a multiplier register 37*c*. Comparators 34*a*, 34*b* influence registers 37*a*, 37*b* and capacitors 33 via conversion logic 39 (i.e., conversion logic 24 in FIG. 2).

Instead of placing initial charges onto capacitors 33 as is done in the prior art, the initial conditions of hybrid integrator 11 can be set by loading a set of binary numbers into exponent register 37*a* and mantissa registers 37*b*.

A register value m within mantissa register 37*b* may be adjusted when output $\lambda_1$ of operational amplifier 32 is approximately equal to an overflow value or an underflow value. A register value p within exponent register 37*a* may be adjusted in response to a change in register value m within mantissa register 37*b*. The exponent register 37*a* along with exponent registers from other integrators influence multiplier register 37*c*.

During operation, register values p and m within registers 37*a* and 37*b*, respectively, change continuously. In order to record the solution of a differential equation, the contents of registers 37*a* and 37*b* may be transferred to a system memory within a digital computer (not shown). The smallest "time step" δt for fetching the solution may be limited by the rate of data transfer to the system memory of the digital computer. By controlling the sizes of various capacitors and resistors within hybrid integrator 11 and the rate of presentation of input signals $g_1$, $x_1$ and $x_j$, where j=2 to 4, the digital computer may control the output speed of the differential equation solution.

Combination circuit 26, which includes a resistor ladder 35 and an operational amplifier 36, combines the analog output of $x_1$ ($\lambda_1$) and the digital output of $x_1$ to yield integrated output $x_1$. Operational amplifier 36 provides integrated output $x_1$ that is approximately equal to an analog output $V_m$ of m of mantissa register 37*b* plus the output $\lambda_1$ of operational amplifier 32. Integrated output $x_1$ from operation amplifier 36 can be scaled.

The threshold voltage $V_o=2^{(1-N)}\,V_s$ at node y is the nodal voltage for the least significant bit of resistor ladder 35, where N is the number of bits for resistor ladder 35.

During operation, a positive input voltage $V_i$ applied to analog integrator 22 may pass through two operational amplifiers 32, 36, rendering a positive integrated output $x_1$. For the sign of component $V_m$ to be consistent, the supply voltage $V_s$ to resistor ladder 35 may be set to a negative value, since resistor ladder 35's output passes through the negative input of operational amplifier 36. For resistor ladder 35 to provide negative values, a sign bit and an appropriate arithmetic, such as 2's complement arithmetic, should be included. To implement 2's complements in the converter output voltages, when the sign bit is set, an additional voltage can be added to operational amplifier 36.

Although the above-mentioned scheme may extend the range of operational amplifier 32, registers 37*a*, 37*b* may eventually overflow or underflow, creating a different magnitude scaling problem. For example, if all bits (excluding the sign bit) of the mantissa m are set, overflow of operational amplifier 32 initiates an increment sequence, and register 37*b* will be overflowed. Such situation can be avoided by introducing an exponent p and extending x to floating point numbers: (m+λ) now becomes an extended mantissa, and the integral is augmented to $x=(m+\lambda)\,2^p$. The value of the exponent p may be increased or decreased to prevent saturation of operational amplifier 32, or to compensate for overflow or underflow of the mantissa m.

Several benefits may accrue. For example, the exponent factor $2^p$ may be used to scale the variable (m+λ), "sliding" the operating range of hybrid integrator 11 up or down as needed to avoid operational amplifier saturation, or "wash out" of small signals by underlying noise. The floating point representation $(m+\lambda)2^p$ is compatible with the digital computer. A logic block 39 can be used to change the gains of operational amplifier 32 and to move or "slide" the voltage range of hybrid integrator 11. Furthermore, overflow can be compensated by rotating mantissa register 37*b* to the right one single bit, followed by incrementing exponent p. Rotating right divides the mantissa and voltage $V_m$ in half. In order to compensate for such effect, exponent p may be incremented.

Such operations may scale the local state variable $x_k=\bar{x}_k\,2^{p_k}$, where exponent $p_k$ records the number of past scaling operations, and the governing differential equation. For example, upon scaling, equation (2) would become $$\bar{x}_k' = \sum_{\substack{j=1\\ j\neq k}}^{n} a_{jk}x_j2^{-p_k} + a_{kk}\bar{x}_k + 2^{-p_k}g_k(t) \tag{3}$$

Since the other hybrid integrators expect $x_k$ and not $\bar{x}_k$, the scaling factor $2^{p_k}$ should be restored when feeding the output of hybrid integrator 11 to other hybrid integrators. That is, the scaling factor $2^{p_k}$ should be restored to $\bar{x}_k$ when the output is sent to another differential equation. This may eliminate the need to inform other integrators that a certain variable was scaled, since keeping track of which variables were scaled and by how much, and then sending information to other integrators, could become onerous when thousands of variables are involved.

For other hybrid integrators feeding their scaled variables $x_k=\bar{x}_k\,2^{p_k}$ to the $k^{th}$ hybrid integrator, equation (3) would become:

$$\bar{x}_k' = \sum_{\substack{j=1 \\ j \neq k}}^{n} a_{jk} \bar{x}_j 2^{p_j - p_k} + a_{kk} \bar{x}_k + 2^{-p_k} g_k(t) \tag{4}$$

This redefines the gain from other hybrid integrators from $a_{jk}$ to $\bar{a}_{jk}=2^{p_j-p_k}a_{jk}$. Logic block 39 can be used to change the gains of operational amplifier 32 via resistor ladder 31.

As has been described, the present invention provides an apparatus for solving differential equations.

While the invention has been particularly shown and described with reference to a preferred embodiment, it will be understood by those skilled in the art that various changes in form and detail may be made therein without departing from the spirit and scope of the invention.

What is claimed is:

1. An apparatus for solving systems of time-continuous differential equations, said apparatus comprising:

a plurality of hybrid integrators interconnected to each other, wherein one of said plurality of hybrid integrators includes an analog integrator for generating an analog output;

a conversion logic and a plurality of digital registers for converting said analog output to a digital output; and a combination circuit for combining said analog output to said digital output to yield an output for said one of said hybrid integrators, wherein said output is fed to said plurality of hybrid integrators.

2. The apparatus of claim 1, wherein register values of said digital registers are adjusted when an output of said analog integrator is equal to a predetermined value.

3. The apparatus of claim 2, wherein said register values are incremented if said predetermined value is a positive overflow value, and said register values are decremented if said predetermined value is a negative overflow value.

4. The apparatus of claim 2, wherein said register values are adjusted via a digital computer.

5. The apparatus of claim 1, wherein said digital registers include a mantissa register and an exponent register.

6. The apparatus of claim 1, wherein said apparatus further includes means for resetting said analog output of said analog integrator.

7. The apparatus of claim 1, wherein said apparatus further includes means for presetting said analog value of said analog output to a predetermined value.

8. The apparatus of claim 7, wherein said apparatus further includes means for scaling said analog output in response to an exponent value adjusted when register values approximately equal to a predetermined mantissa value.

9. The apparatus of claim 8, wherein said apparatus further includes means for scaling said analog input in response to a second exponent value in one of said digital registers.

10. The apparatus of claim 1, wherein said analog integrator includes an operational amplifier;

a first capacitor coupled to said operational amplifier;

a second capacitor coupled to said operational amplifier; and a switch capable of selectively coupling said operational amplifier to either said first capacitor or said second capacitor.

* * * * *